United States Patent [19]

Niccolini

[11] 4,204,941

[45] May 27, 1980

[54] PROCESS FOR THE MANUFACTURE OF A PERMEABLE DIAPHRAGM FOR AN ELECTROLYSIS CELL

[75] Inventor: Giuseppe Niccolini, Catiglioncello, Italy

[73] Assignee: Solvay & Cie, Belgium

[21] Appl. No.: 948,777

[22] Filed: Oct. 5, 1978

[30] Foreign Application Priority Data

Oct. 19, 1977 [LU] Luxembourg ..... 78350/77

[51] Int. Cl.[2] ..... C25B 13/06; C25B 13/08

[52] U.S. Cl. ..... 204/296; 204/252; 204/282; 204/283; 204/295

[58] Field of Search ..... 204/301, 295, 296, 252, 204/253, 128, 80, 282, 283; 162/146

[56] References Cited

U.S. PATENT DOCUMENTS

| | | | |
|---|---|---|---|
| 2,526,125 | 10/1950 | Francis, Jr. | 162/146 |
| 3,723,264 | 3/1973 | Leduc et al. | 204/80 |
| 3,853,720 | 12/1974 | Korach et al. | 204/128 |
| 3,945,910 | 3/1976 | DeCeuster et al. | 204/296 |

FOREIGN PATENT DOCUMENTS

| | | | |
|---|---|---|---|
| 654224 | 12/1962 | Canada | 204/146 |
| 700296 | 12/1964 | Canada | 204/296 |
| 1410313 | 10/1975 | United Kingdom | 204/296 |

*Primary Examiner*—Arthur O. Prescott

*Attorney, Agent, or Firm*—Robert E. Burns; Emmanuel J. Lobato; Bruce L. Adams

[57] ABSTRACT

The invention relates to a process for the maufacture of a permeable diaphragm for electrolysis cells.

The process consists of forming a sheet comprising inorganic fibres and a polyelectrolyte in the form of a finely divided solid which is insoluble in aqueous solutions of alkali metal halides, and of then heating the said sheet to melt the polyelectrolyte.

The diaphragms thus obtained are particularly suitable for cells for the electrolysis of sodium chloride brines.

12 Claims, No Drawings

PROCESS FOR THE MANUFACTURE OF A PERMEABLE DIAPHRAGM FOR AN ELECTROLYSIS CELL

The present invention relates to the manufacture of permeable diaphragms based on inorganic fibres such as asbestos, which diaphragms are intended for cells for the electrolysis of aqueous solutions of alkali metal halides such as sodium chloride or potassium chloride.

It relates more particularly to a process for obtaining diaphragms of this type which exhibit good dimensional stability, that is to say whose thickness remains virtually unchanged during their use in an electrolysis cell.

In the known diaphragm cells, in particular the cells for the electrolysis of a sodium chloride brine, the diaphragm usually consists of a layer or sheet of asbestos, applied to a perforated iron structure which forms the cathode of the cell.

However, the known diaphragms consisting of asbestos suffer from the disadvantage that they are dimensionally unstable over a period of time. At the start of the electrolysis, these known diaphragms tend to swell and this swelling is followed by a progressive compression under the effect of the hydrostatic pressure prevailing in the cell. These variations in the volume and shape of the diaphragms with time have an unfavourable effect on the electrolysis. They furthermore have a disadvantageous effect on the cell geometry to be adopted. In particular, the swelling of the diaphragm at the start of its use makes it necessary to provide anode-cathode spacings in the cell which are markedly greater than the optimum value required for a cell in operation.

To increase the cohesion of the asbestos diaphragms and improve their stability of shape, and dimensional stability, it has been propsoed, in German Pat. application No. 2,140,714 of Tokuyama Soda K.K., filed on Aug. 13, 1971, to add to the asbestos fibres of the diaphragm a binder consisting of a fluorinated polymer employed in the form of an aqueous dispersion. The diaphragm thus obtained must subsequently be heated to a high temperature to melt the polymer (at least 295° C. according to the examples), and this is a disadvantage.

In a variant of this known process, described in Belgian Pat. No. 809,822 of Diamond Shamrock Corporation, filed on Jan. 16, 1974, an aqueous suspension of asbestos fibres and of particles of a thermoplastic, generally fluorinated, polymer is formed, and the suspension is sucked through the perforated cathode in order to deposit thereon a diaphragm consisting of a substantially homogeneous mixture of asbestos fibres and the polymer, and the diaphragm is heated to a high temperature, for example above 300° C., to melt the polymer and to allow it to bond the asbestos fibres to one another.

However, the difficulty which arises in these two known processes is to ensure effective adhesion of the molten polymer to the asbestos fibres. The use of the process described in the abovementioned Belgian Pat. No. 809,822 presents the additional difficulty of ensuring homogeneous dispersion of the polymer particles in the aqueous suspension of asbestos and polymer.

To reduce this disadvantage, the abovementioned Belgian Pat. No. 809,822 proposes to add a surfactant to the aqueous suspension of asbestos and polymer. Though it noticeably improves the dispersion of the polymer particles in the aqueous suspension, and the adhesion of the polymer to the asbestos fibres, the use of a surfactant suffers from the disadvantage of causing substantial foaming in the cell at the start of the electrolysis, principally in the cathode chamber.

The Applicant has now found that by using particular polymers it is possible to obviate the abovementioned disadvantages of the known processes.

Hence, the invention relates to a process for the manufacture of a permeable diaphragm for a cell for the electrolysis of aqueous solutions of alkali metal halides, in which a sheet comprising inorganic fibres and a polymer in the form of a finely divided solid is formed and the sheet is heated so as to melt the polymer; according to the invention the polymer is selected from amongst the polyelectrolytes which are insoluble in aqueous solutions of alkali metal halides.

In the process according to the invention, the inorganic fibres are selected so as to resist the corrosive action of the electrolysis baths. They consist advantageously of asbestos fibres such as fibres of chrysotile asbestos or fibres of amphibole asbestos, especially of crocidolite or of anthophylite.

By polyelectrolyte there is understood any polymeric substance which comprises monomer units possessing ionisable groups, in accordance with the generally accepted definition (Encyclopedia of Polymer Science and Technology, Volume 10, page 781, 1969, John Wiley and Sons).

Within the scope of the invention, it is preferred to use polyacids, which are polyelectrolytes containing acidic groups which, on dissociation, give rise to polymeric anions (polyanions) and to elementary cations (counter-ions) such as protons or monovalent cations.

Examples of acid groups which can be present in the polyacids usable according to the invention are sulphonic acid groups and phosphonic acid groups. In general, it is preferred to use polyacids possessing from 0.1 to 50, and more particularly from 1 to 20, acid groups per 100 carbon atoms.

Particularly suitable polyacids are carboxylic polyacids, in which the ionisable groups are carboxylic acid groups. Advantageously, these polyacids contain monomeric units comprising one or more carboxylic acid groups, which monomeric units can be derived from unsaturated carboxylic acids, such as acrylic acid, alpha-chloroacrylic acid, methacrylic acid, alpha-hydroxyacrylic acid and fumaric acid, containing up to 10 carbon atoms per molecule. The best results are obtained with the polyacids containing units derived from maleic acid.

In addition to the carboxylic acid monomer units, the carboxylic polyacids, the use of which is preferred, advantageously contain olefinic monomer units derived from unsubstituted alpha-olefines containing from 2 to 10 carbon atoms and preferably from 2 to 6 carbon atoms in their molecule. Preferably, the carboxylic polyacids contain at least 50% by weight of such olefinic monomer units. The best results are obtained with carboxylic polyacids which only contain such olefinic monomer units and carboxylic acid monomer units. As examples of alpha-olefines from which the olefinic monomer units can be derived, there may be mentioned ethylene, propylene, 1-butene, 4-methyl-1-pentene and 1-octene. Amongst these, propylene and more particularly ethylene are very particularly advantageous because they give carboxylic polyacids of low melting point.

As explained above, the carboxylic polyacids preferably used in the process according to the invention are, advantageously, copolymers of unsubstituted alpha-olefines and of unsaturated carboxylic acid monomers. These copolymers can be of the random, block or graft type. The latter, in which the main chain is a polyolefinic structure and the side chains carry carboxylic acid groups, are preferred.

Though the carboxylic polyacids can be employed in any ionisable form, and in particular in the form of salts, during manufacture of the diaphragm, it is preferred to use them in the form of acids or of anhydrides.

Polymers which are particularly suitable are the polyolefines containing from 0.3 to 1% by weight of carboxylic acid monomer units, especially polyethylene and polypropylene containing from 0.3 to 1%, preferably approximately from 0.5 to 0.7%, of maleic anhydride.

In the process according to the invention, it is desirable to incorporate into the sheet a sufficient amount of polyelectrolyte for the latter to be able to become interposed between the individual inorganic fibres and to bond them effectively to one another once it has been melted, so as to resist swelling of the diaphragm during its use in an electrolysis cell. The minimum amount of polyelectrolyte required depends on the nature of the polyelectrolyte and can easily be determined by experience. In general terms, at least 1%, preferably at least 5%, by weight of polyelectrolyte is incorporated into the diaphragm sheet. It is preferable not to exceed 70% by weight of polyelectrolyte in the diaphragm. In general, good results are obtained by preferably incorporating into the sheet from 5 to 20% by weight of polyelectrolyte.

As a variant, it is also possible to incorporate into the diaphragm sheet other usual constituents of permeable diaphragms, such as organic fibres or additives intended to impart particular properties to the diaphragm. In the particular case where the process according to the invention is applied to the manufacture of an asbestos-based diaphragm, it is for example possible to incorporate into the diaphragm, by way of an additive, particles of iron, iron oxide, of copper or of copper oxide, as described in Belgian Pat. No. 773,918, of Oct. 14, 1971.

According to the invention, the polyelectrolyte can be incorporated into the diaphragm sheet in any finely divided solid form, for example in the form of particles such as granules, flakes or short fibres. Preferably, the polyelectrolyte is incorporated in the form of fibrids.

By fibrids there is understood a specific structure consisting of an aggregate of a multitude of very thin filaments, of film-like appearance, connected to one another so as to form a three-dimensional network. The fibrids have a flake-like appearance and are oblong in shape; their length varies approximately from 0.5 to 55 mm and their diameter approximately from a few microns to 5 mm. They are characterised by a high specific surface area, greater than 1 $m^2/g$ and in many cases even greater than 10 $m^2/g$.

The polyelectrolyte fibrids used in accordance with this variant of the invention can be manufactured by any process which is in itself known, in particular by grafting monomer units containing ionisable groups onto thermoplastic polymers and more particularly onto polyolefines derived from ethylene or propylene. The process described in Belgian Pat. No. 847,491 of Oct. 21, 1976 can be used advantageously; according to this process, the monomers units containing ionisable groups are grafted onto a molten thermoplastic polymer in a solvent, after which the mixture of solvent and grafted polymer is subjected to an abrupt pressure release, capable of causing the instantaneous vaporisation of the solvent and the solidification of the polymer in the form of fibrids.

In the process according to the invention, the duration of heating, and the heating temperature, to which the sheet is subjected, depend on the nature of the polyelectrolyte and on the form in which it is incorporated into the diaphragm sheet. They must be chosen so as to result in sufficient melting of the polyelectrolyte for the latter to coat the inorganic fibres partially and to weld them to one another. Usually, temperatures between 130° and 250° C. suffice, as do periods of time of between 1 and 60 minutes.

The process according to the invention is equally applicable to the manufacture of preformed permeable diaphragms, obtained, for example, in accordance with papermaking techniques, and to the manufacture of diaphragms in situ on a perforated support (which can for example be the perforated cathode of a diaphragm cell), applying the technique described in U.S. Pat. No. 1,865,152 in the name of K. E. STUART, of June 28, 1932, or in U.S. Pat. No. 3,344,053 in the name of NEIPERT et al., of May 4, 1964.

Thus, a plane coherent sheet can for example be manufactured from inorganic fibres and a polyelectrolyte, for example in the form of fibrids, in accordance with a technique used in papermaking. The sheet is subsequently drained, for example by calendering, dried and then heated to a sufficient temperature, and for a sufficient length of time, to melt the polyelectrolyte.

According to another embodiment, a sheet of inorganic fibres and of polyelectrolyte can be manufactured on a perforated support by sucking through the support an aqueous suspension of inorganic fibres and of polyelectrolyte, so as to form a felt which matches the contours of the perforated support. Preferably, an aqueous medium is used to disperse the inorganic fibres and the polyelectrolyte, which aqueous medium advantageously consists of an aqueous sodium hydroxide solution; preferably, a sodium hydroxide brine obtained by electrolysis of a sodium chloride brine in a diaphragm cell is used. To ensure efficient dispersion of the inorganic fibres and of the polyelectrolyte in the aqueous medium, the latter can advantageously be subjected to a beating treatment whilst introducing the fibres and the polyelectrolyte, using for this purpose the process and the device described in French Pat. No. 2,308,702, filed on Apr. 25, 1975.

The sheet thus obtained is then dried and thereafter heated on its support to a sufficient temperature, and for a sufficient length of time, to melt the polyelectrolyte, at least superficially, so as to weld the inorganic fibres to one another.

In this preferred embodiment of the process according to the invention, the polyelectrolyte is advantageously used in the form of fibrids.

All other things being equal, the choice, according to the invention, of a polyelectrolyte as the polymer in the diaphragm greatly improves, at one and the same time, the homogeneity of the diaphragm, its stability of shape and dimensional stability, and its wettability by aqueous electrolytes during its use in an electrolysis cell. The invention thus has the advantage of improving the permeability of the diaphragms. It furthermore provides the considerable advantage that a surfactant is no longer necessary for the manufacture of the diaphragms and thus foaming in the electrolysis cells is avoided. Finally, it does not entail heating the diaphragm to high temperatures.

The value of the process according to the invention will be clear on reading the examples of its application which follow.

In the application examples which follow, some electrolysis tests were carried out in a cell with vertical electrodes separated by a diaphragm. The anode consisted of a titanium plate carrying an active coating of mixed crystals consisting of 50% by weight of ruthenium dioxide and 50% by weight of titanium dioxide.

The cathode consisted of a mild steel network of which the face located opposite the anode was covered with a diaphragm.

EXAMPLE 1

A diaphragm manufactured in accordance with the process of the invention was applied to the cathode of the cell. For this purpose, an aqueous suspension of chrysotile asbestos fibres and of fibrids of polyethylene grafted with about 0.6% of maleic anhydride was first prepared. The fibrids used had a length not exceeding 2 mm and their mean specific surface area was 14 $m^2/g$.

To prepare this aqueous suspension, 200 g of fibrids were first dispersed in 70 l of an alkaline brine containing approximately 8% by weight of sodium hydroxide and 16% by weight of sodium chloride. The resulting suspension was then stirred for 5 minutes, after which 2,440 g of asbestos were dispersed therein, and stirring was continued for 9 seconds. The homogeneous suspension thus obtained was then diluted to a total volume of 525 l by adding a supplementary amount of alkaline brine.

After having prepared the aqueous suspension as described above, the cathode of the cell was immersed therein and the said aqueous suspension was sucked through the network of the cathode by setting up a uniformly increasing suction up to a value corresponding approximately to a 500 mm column of mercury, for about 10 minutes. The cathode was then removed from the suspension and the diaphragm was successively dried at 90° C. for one hour and heated at 160° C. for one hour to melt the fibrids.

The diaphragm obtained at the end of the treatment weighed 1.42 $kg/m^2$.

For the electrolysis test, the anode-cathode distance was adjusted to 6 mm.

An aqueous solution containing about 250 g of sodium chloride per liter was electrolysed in the cell at 80° C., with an anode current density of 2 $kA/m^2$. An electrolysis potential of 3.2 V was measured at the terminals of the cell, and the yield of chlorine from the electrolysis amounted to 93.5%. The energy consumption per tonne of chlorine produced was 2,580 kWh.

EXAMPLE 2

By way of comparison, the experiment of Example 1 was repeated, but omitting the introduction of the polymer fibrids into the aqueous asbestos suspension used to produce the diaphragm. The heat treatment at 160° C. was also omitted.

For the electrolysis test, an anode-cathode distance of 6 mm was used, as in the experiment of Example 1. The diaphragm swelled from the start of the electrolysis until it occupied virtually the whole space separating the anode from the cathode, so that it was impossible to reach a stationary operating state of the cell.

EXAMPLE 3

The experiment of Example 2 was repeated, but this time employing an anode-cathode distance of 12 mm to compensate for the swelling of the diaphragm. The following electrolysis results were measured:

| | |
|---|---|
| potential at the terminals: | 3.45 V |
| current efficiency: | 95.7% |
| energy consumption: | 2,726 kWh/tonne of chlorine. |

A comparison of the results of Example 1 (according to the invention) with those of Examples 2 and 3 shows the advantage of the diaphragms obtained by the process according to the invention in respect of the bulkiness, and the energy yield, of the electrolysis cells.

Compared to the process described in the abovementioned Belgian Pat. No. 809,822, Example 1 furthermore shows that in the process according to the invention the heating of the diaphragm can be run at a much lower temperature.

I claim:

1. Process of manufacturing a liquid permeable diaphragm for a cell for the electrolysis of aqueous solutions of alkali metal halides, which comprises forming a sheet comprising inorganic fibres and a polymer in the form of finely divided solid dispersed in said sheet, said polymer being selected from amongst the polyelectrolytes which are insoluble in aqueous solutions of alkali metal halides, and heating said sheet to at least partially melt said polymer sufficiently for said polymer to coat said inorganic fibres partially and to weld them to one another.

2. Process according to claim 1, in which said polyelectrolyte is selected from amongst the polyacids having from 1 to 20 acid groups per 100 carbon atoms.

3. Process according to claim 1, in which said polyelectrolyte comprises a carboxylic polyacid containing monomer units derived from unsaturated carboxylic acids containing up to 10 carbon atoms in their molecule.

4. Process according to claim 3, in which said carboxylic polyacid contains units derived from maleic acid.

5. Process according to claim 3, in which said carboxylic polyacid contains at least 50% by weight of monomer units derived from unsubstituted alpha-olefines containing from 2 to 6 carbon atoms in their molecule.

6. Process according to claim 5, in which said carboxylic polyacid is a graft copolymer of ethylene or of propylene.

7. Process according to claim 1, in which said sheet contains from 1% to 20% by weight of said polyelectrolyte.

8. Process according to claim 1, in which said polyelectrolyte is employed in the form of fibrids.

9. Process according to claim 1, in which said inorganic fibres are asbestos fibres.

10. Process according to claim 9, in which said asbestos fibres are of amphibole asbestos.

11. Process according to claim 1, in which said sheet is formed by dispersing said inorganic fibres and said polyelectrolyte in particulate form in an aqueous medium, filtering the resulting aqueous suspension through a perforate support to form a sheet of said inorganic fibres and polyelectrolyte, and thereafter drying said sheet.

12. Process according to claim 11, in which said polyelectrolyte is in the form of fibrids.

* * * * *